US009598090B1

(12) United States Patent
Maysonet

(10) Patent No.: US 9,598,090 B1
(45) Date of Patent: Mar. 21, 2017

(54) VERTICALLY RETRACTABLE SAFETY PLATFORM SYSTEM FOR USE WITH SUBWAY TRAINS AND ASSOCIATED METHOD

(71) Applicant: Ignacio R. Maysonet, Bronx, NY (US)

(72) Inventor: Ignacio R. Maysonet, Bronx, NY (US)

( * ) Notice: Subject to any disclaimer, the term of this patent is extended or adjusted under 35 U.S.C. 154(b) by 335 days.

(21) Appl. No.: 14/165,841

(22) Filed: Jan. 28, 2014

(51) Int. Cl.
*B61B 1/02* (2006.01)

(52) U.S. Cl.
CPC ..... *B61B 1/02* (2013.01)

(58) Field of Classification Search
CPC ..... B61B 1/02; E01F 1/00
USPC ..... 104/30, 31; 105/425, 436
See application file for complete search history.

(56) References Cited

U.S. PATENT DOCUMENTS

| | | | | |
|---|---|---|---|---|
| 1,098,298 | A | 5/1914 | Porth | |
| 1,216,560 | A | 2/1917 | Gallinant | |
| 4,188,889 | A | 2/1980 | Favrel | 105/445 |
| 5,357,869 | A | 10/1994 | Barjolle et al. | 105/436 |
| 5,517,921 | A | 5/1996 | Klohn | |
| 5,775,232 | A | 7/1998 | Golemis et al. | 105/458 |
| 6,105,905 | A * | 8/2000 | Spence | B61L 29/04 104/28 |
| 6,167,816 | B1 | 1/2001 | Lavery et al. | 105/458 |
| 6,352,034 | B1 | 3/2002 | Bolliger et al. | 104/53 |
| 8,020,496 | B1 | 9/2011 | Maysonet | |
| 2009/0106918 | A1 | 4/2009 | Van Roosmalen et al. | 14/69.5 |

FOREIGN PATENT DOCUMENTS

KR WO 2005007479 A1 * 1/2005 ..... B61B 1/02

* cited by examiner

*Primary Examiner* — Zachary Kuhfuss

(57) ABSTRACT

A retractable safety platform system for use between a train and a station platform, to thereby ensure a passenger will not fall or be pushed onto a path of the train, includes a rigid barricade platform adapted to be anchored to an outwardly facing side of the station platform registered along a vertical plane, and a mechanism for automatically reciprocating the barricade platform along a vertical linear travel path upon detecting first and second triggering events respectively. The linear travel path is defined along the vertical plane extending above and below a top surface of the station platform. In this manner, the barricade platform is displaced from a lowered retracted position to a raised extended position when the first triggering event is detected. The barricade platform is displaced from the raised extended position to the lowered retracted position when the second triggering event is detected.

20 Claims, 5 Drawing Sheets

VERTICALLY RETRACTABLE SAFETY PLATFORM SYSTEM FOR USE WITH SUBWAY TRAINS AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE DISCLOSURE

Technical Field

This disclosure relates to retractable platforms and, more particularly, to a retractable safety platform system for providing a physical barricade platform along with audio and visual warning messages at a station platform so that a passenger will not fall or be pushed onto a path of an oncoming train.

Prior Art

I am the inventor of the patented subject matter claimed in U.S. Pat. No. 8,020,496 ("496 patent") derived from U.S. patent application Ser. No. 12/381,828, filed Mar. 17, 2009, now abandoned, which claims the benefit of provisional application 61/069,624, filed Mar. 17, 2008, now abandoned. The claimed subject matter of the present application covers patentable modifications to the claimed subject matter of the '496 patent. The file wrapper of the '496 patent—and associated patent application(s) referenced above—are incorporated herein by reference in their entireties.

America in the 21$^{st}$ century is a nation of commuters. Most of us work someplace outside the home, and for most of us, that place lies somewhere down the highway. For commuters who live in the suburbs or, increasingly, the farther removed "exurbs," the commute can be extreme. It is not uncommon for a person employed in San Francisco to live in Modesto or Gilroy, and drive several hours twice a day; and similarly highway-bound existences can be found on the ever-receding peripheries of any major city. Still, with all the news about road-rage, traffic jams, and the mounting hassles of the commuter lifestyle, we may forget that millions of Americans commute in another manner—by train. Trains offer certain advantages when it comes to the morning and evening commute.

For one thing, it's entirely possible to read the newspaper on the morning train and take a nap on the evening commute. The countryside reels past, the click of the wheels on the tracks instills a reassuring rhythm in the mind and body, and the train proceeds (on most days) like clockwork, traveling down its accustomed track by predestination. On a commuter train, one can relax and prepare for—or forget, once they've been met—the demands of the business day. The commuter brethren on the highway, meanwhile, are engaged in a heart-pounding, high-stakes game that is equal parts patience and aggression; small wonder that they come home exhausted and irritable, hands shaking until the first cocktail is down. Given the choice, what veteran of the highway commute would not prefer the train?

Then again, commuting by train or subway does have its downside. For one thing, the train commuter must navigate among a sea of strangers each morning and evening, generally at times when he or she most craves silence and solitude. For subway commuters, this lack of privacy and personal space is extreme, as one is frequently shoulder-to-shoulder, standing in a closely packed crowd of fellow riders. On trains, one's seatmate is often a stranger, and not always a polite or agreeable one.

And then there is the rush out the doors when the train reaches the platform or station—"people pushing, people shoving," as one rock-n-roll song put it, "on the 8:15 into the city." On top of all this, there is the very real hazard involved in actually stepping off the train and onto the platform. You have to consciously step out, or risk falling between the train and the concrete—a mistake that could be the ruin of your day, certainly, if not your life. In the hurly-burly of the commute, people do in fact fall and get injured between trains and platforms, a problem that the present disclosure will solve.

Platform gaps, up to 15 inches wide, can be caused by a station's curvature and the design of trains, whose sides are straight. Fliers, posters and yellow stickers on train doors urge riders to "Watch the Gap." Subway and commuter train stations are busy, crowded places where large groups of people are constantly in motion, and frequently in motions opposed to one another. Scrambling to get aboard a train, or attempting to get off at the station, a passenger frequently finds himself or herself in an anxious, distracted state of mind—a state more likely to lead to a potentially catastrophic misstep.

Accordingly, the present disclosure is disclosed in order to overcome the above noted shortcomings. The vertically retractable platform system is convenient and easy to use, lightweight yet durable in design, and designed to a physical barricade platform along with audio and visual warning messages at a station platform so that a passenger will not fall or be pushed onto a path of an oncoming train.

BRIEF SUMMARY OF THE DISCLOSURE

In view of the foregoing background, it is therefore an object of the present disclosure to provide a retractable barricade platform system including a physical barricade platform along with audio and visual warning messages at a station platform so that a passenger will not fall or be pushed onto a path of an oncoming train. These and other objects, features, and advantages of the disclosure are provided by a retractable safety platform system for use between a train and a station platform thereby ensuring a passenger will not fall or be pushed onto a path of the train.

Such a retractable safety platform system includes a rigid barricade platform adapted to be anchored to an outwardly facing side of the station platform registered along a vertical plane, and a mechanism for automatically reciprocating the barricade platform along a vertical linear travel path upon detecting first and second triggering events respectively. Notably, the linear travel path is defined along the vertical plane extending above and below a top surface of the station platform. In this manner, the barricade platform is displaced from a lowered retracted position to a raised extended position when the first triggering event is detected. Likewise, the barricade platform is displaced from the raised extended position to the lowered retracted position when the second triggering event is detected.

In a non-limiting exemplary embodiment, a plurality of light sources are attached to an inwardly facing side of the barricade platform. Such light sources are selectively illuminated between active and inactive modes when the first triggering event and the second trigger event are detected, respectively.

In a non-limiting exemplary embodiment, such illuminable light sources include, for example, warning lights. In addition, emergency stop sensors (similar to an elevator door), rubberized bottom cushions and an audio warning system may be employed by the light sources. For example, audible messages are replayed to remind passengers to stand away from the outwardly facing side of the barricade platform) before barricade platform is vertically raised (closed) and lowered (opened). Thus, the subject matter of the disclosure creates both audio and visual messages with a physical barricade platform at the station platform so that no one will fall or be pushed onto the path of an oncoming train. The vertical displacement of a barricade platform allows connection to the barricade platform and stops people from falling or being pushed onto train tracks. The barricade platform also has sensors to automatically stop and/or reverse directions in case someone or something is obstructing its vertical travel path. Thus, the controller automatically learns when it is safe to vertically raise and lower the barricade platform as the train approaches and departs. Of course, a manual override switch is provided as well.

In a non-limiting exemplary embodiment, the automatic barricade platform reciprocating mechanism preferably includes a power-actuated drive mechanism centrally engaged to a bottom surface of the barricade platform wherein the drive mechanism is adapted to be connected to the outwardly facing side of the station platform, a controller including a processor and a memory communicatively coupled thereto, a plurality of sensors located at the barricade platform and being communicatively coupled to the controller respectively, and a light switch communicatively coupled to the controller and the light sources. In this manner, the controller causes the drive mechanism to toggle between alternate operating modes upon detecting the first and second triggering events respectively. Furthermore, the controller causes the light switch to toggle between closed and open positions upon detecting the first and second triggering events respectively.

In a non-limiting exemplary embodiment, the memory includes programmable software instructions that cause the controller to verify an authenticity of the first and second triggering events.

In a non-limiting exemplary embodiment, a first group of the sensors generates and transmits true first output signals upon detecting the first triggering event respectively. A second group of the sensors generating and transmitting true second output signals upon detecting the second triggering event respectively. In this manner, the first and second sensor groups generate and transmit respective first and second false output signals when the first and second triggering events are not detected.

In a non-limiting exemplary embodiment, the controller is responsive to the first and second outputs signals and thereby generates and transmits first and second control signals to the drive mechanism upon receiving the true first and second output signals respectively. Notably, upon receiving the first and second control signals, the drive mechanism is caused to rotate in clockwise and counter clockwise directions respectively. Furthermore, upon receiving the true first and second output signals, the controller further generates and transmits third and fourth control signals to the light switch thereby toggling the light switch between the closed position and the open position respectively. In this manner, the light sources are activated and deactivated when the light switch is at the closed position and open position, respectively.

In a non-limiting exemplary embodiment, the drive mechanism includes a rotary motor adapted to be coupled to an existing power source located at the barricade platform, and a plurality of rectilinear drive shafts directly coupled to the rotary motor respectively wherein each of the drive shafts is coupled to the rotary motor and oppositely extends away therefrom respectively. Notably, the drive shafts are registered along a linear axis oriented parallel to a rear edge of the barricade platform.

In a non-limiting exemplary embodiment, the drive mechanism further includes a driven shaft spaced from the drive shafts and registered parallel thereto, a plurality of primary cogwheels anchored to respective distal ends of the drive shafts wherein each of the primary cogwheels is synchronously rotated with the drive shafts as the motor rotates in the clockwise and counter clockwise directions. A plurality of secondary cogwheels are anchored to distal ends of the driven shaft wherein each of the secondary cogwheels is synchronously rotated with the driven shaft as the motor rotates in the clockwise and counter clockwise directions.

In a non-limiting exemplary embodiment, the drive mechanism further includes a plurality of primary serrated tracks statically connected directly to the bottom surface of the barricade platform wherein the primary serrated tracks are configured in such a manner that the primary cogwheels remain continuously and directly engaged with the primary serrated tracks during the reciprocating motions. A plurality of secondary serrated tracks statically connected directly to the bottom surface of the barricade platform wherein the secondary serrated tracks are configured in such a manner that the secondary cogwheels remain continuously and directly engaged with the secondary serrated tracks during the reciprocating motions.

In a non-limiting exemplary embodiment, the barricade platform is caused to linearly reciprocate along the vertical plane as the drive shafts, the driven shaft, the primary cogwheels, and the secondary cogwheels rotate along the clockwise and counter clockwise directions respectively.

In a non-limiting exemplary embodiment, the automatic barricade platform reciprocating means further includes a plurality of primary protective guide rails situated at opposed lateral ends of the barricade platform respectively, wherein such primary protective guide rails are anchored to the outwardly facing side of the station platform. A plurality of secondary protective guide rails situated at opposed lateral ends of the barricade platform respectively, wherein such secondary protective guide rails being anchored to the outwardly facing side of the station platform. A plurality of primary guide wheels rotatably attached within each of the primary protective guide rails, wherein the primary guide wheels are configured in such a manner that the barricade platform remains intercalated between anterior and posterior rows of the primary protective guide rails while reciprocating between the retracted and extended positions respectively. A plurality of secondary guide wheels are rotatably attached within each of the secondary protective guide rails, wherein the secondary guide wheels are configured in such a manner that the barricade platform remains intercalated between anterior and posterior rows of the secondary protective guide rails while reciprocating between the retracted and fully extended positions respectively.

In a non-limiting exemplary embodiment, each of the primary protective guide rails and the secondary protective guide rails has a longitudinal length registered parallel to the linear travel path of the barricade platform for maintaining the barricade platform at a substantially stable position during repeated reciprocating movement.

For any hurried commuter—and especially for those elderly or mobility-restricted commuters for whom these transitions are a particular obstacle—the retractable safety platform system provides a convenient, reliable barrier between the train and the station platform.

The present disclosure further includes a method of utilizing a retractable barricade platform system between a train and a station platform thereby ensuring a passenger will not fall or be pushed onto a path of the train. Such a method includes the steps of: providing and anchoring a rigid barricade platform to an outwardly facing side of the station platform registered along a vertical plane; and providing a mechanism for automatically reciprocating the barricade platform along a vertical linear travel path upon detecting first and second triggering events respectively, wherein the linear travel path is defined along the vertical plane extending above and below a top surface of the station platform.

The method further includes the steps of: when the first triggering event is detected, displacing the barricade platform from a lowered retracted position to a raised extended position; and when the second triggering event is detected, displacing the barricade platform from the raised extended position to the lowered retracted position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the disclosure of the application, which is measured by the claims, nor is it intended to be limiting as to the scope of the disclosure in any way.

BRIEF DESCRIPTION OF THE SEVERAL VIEWS OF THE DRAWING

The novel features believed to be characteristic of this disclosure are set forth with particularity in the appended claims. The disclosure itself, however, both as to its organization and method of operation, together with further objects and advantages thereof, may best be understood by reference to the following description taken in connection with the accompanying drawings in which:

Figure 1:
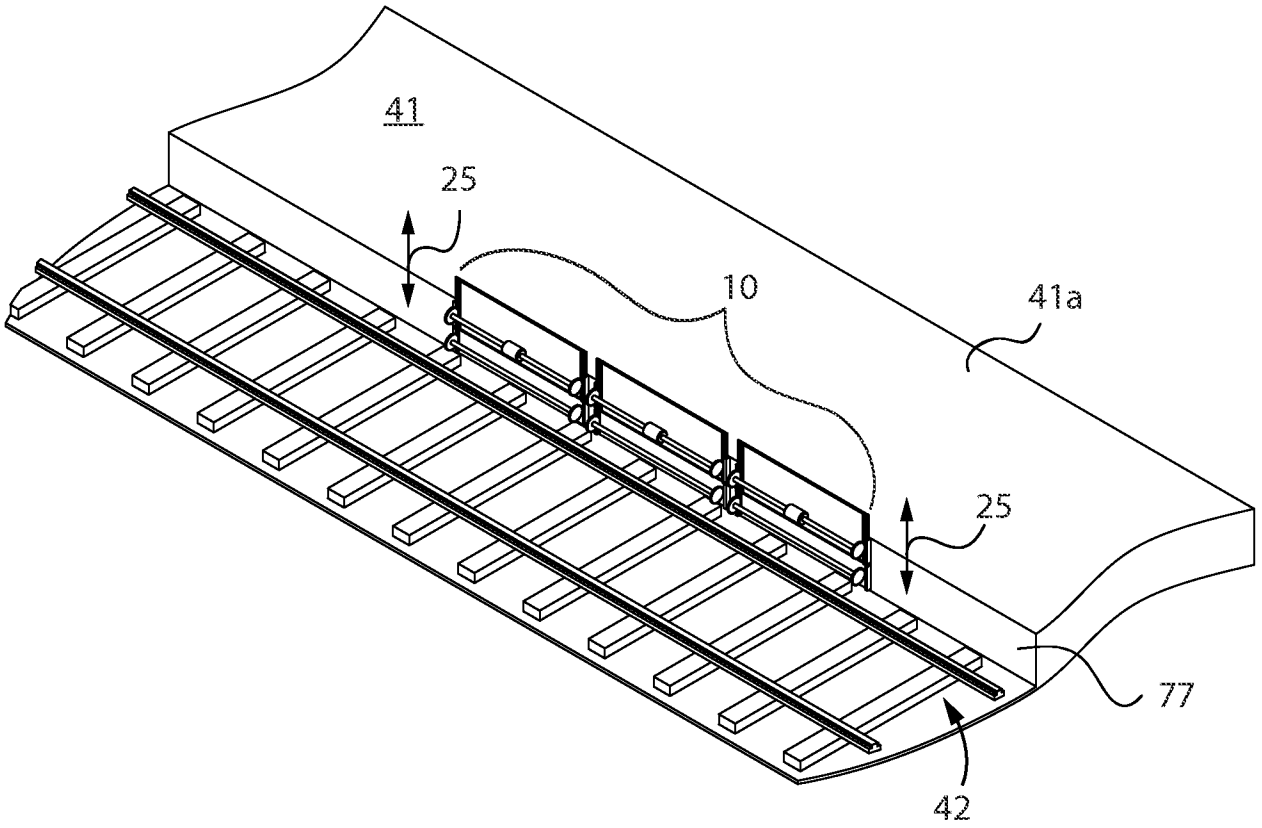
FIG. 1 is a perspective view showing an exemplary environment at which an automated retractable safety platform system is employed, in accordance with an embodiment of the present disclosure.

Those skilled in the art will appreciate that the figures are not intended to be drawn to any particular scale; nor are the figures intended to illustrate every embodiment of the disclosure. The disclosure is not limited to the exemplary embodiments depicted in the figures or the shapes, relative sizes or proportions shown in the figures.

DETAILED DESCRIPTION OF THE DISCLOSURE

The present disclosure will now be described more fully hereinafter with reference to the accompanying drawings, in which a preferred embodiment of the disclosure is shown. This disclosure may, however, be embodied in many different forms and should not be construed as limited to the embodiment set forth herein. Rather, this embodiment is provided so that this application will be thorough and complete, and will fully convey the true scope of the disclosure to those skilled in the art. Like numbers refer to like elements throughout the figures.

I am the inventor of the patented subject matter claimed in U.S. Pat. No. 8,020,496 ("496 patent") derived from U.S. patent application Ser. No. 12/381,828, filed Mar. 17, 2009, now abandoned, which claims the benefit of provisional application 61/069,624, filed Mar. 17, 2008, now abandoned. The claimed subject matter of the present application covers patentable modifications to the claimed subject matter of the '496 patent. The file wrapper of the '496 patent—and associated patent application(s) referenced above, are incorporated herein by reference in their entireties.

The system of this disclosure is referred to generally in FIGS. 1-6 by the reference numeral 10 and is intended to provide a vertically retractable safety platform system 10 employing a barricade platform 11 and audio and visual warning messages at a train station platform 41 so that a passenger will not fall or be pushed onto a path of an oncoming train. It should be understood that the vertically retractable safety platform system 10 may be used to provide a barricade between many different types of commuter trains and associated platforms.

The retractable safety platform system 10 would preclude the possibility of a passenger falling into the path of an oncoming train at the station platform 41, and thus prevent the serious injuries. With the pressure of people behind, each of them equally intent on getting on or off, the hazards grow to unacceptable levels. As a consequence, people trip and fall, and sometimes fall over the outwardly facing side 77 of the station platform 41. The retractable safety platform system 10 is designed to provide a barrier and to make such a fall impossible. Designed to vertically reciprocate along the outwardly facing side 77 of the station platform 41 an instant before train doors open, and an instant after the train doors close, the system 10 would operate automatically, providing access to the train doors from the station platform 41.

Still referring to FIGS. 1-6, the retractable safety platform system 10 includes a rigid barricade platform 11 adapted to be anchored to an outwardly facing side 77 of the station platform 41 registered along a vertical plane (along linear travel path 25), and a mechanism 12 for automatically reciprocating the barricade platform 11 along a vertical linear travel path 25 upon detecting first and second triggering events, respectively. Notably, the linear travel path 25 is defined along the vertical plane extending above and below a top surface 41*a* of the station platform 41. In this manner, the barricade platform 11 is displaced from a lowered retracted position to a raised extended position (both along linear travel path 25) when the first triggering event is detected. Likewise, the barricade platform 11 is displaced from the raised extended position to the lowered retracted position when the second triggering event is detected. Such first and second triggering events may be defined as opening and closing operations of the train doors. However, the triggering events may also be defined when the train comes to a complete stop and begins moving thereafter, respectively.

In a non-limiting exemplary embodiment, a plurality of light sources 65-67 are attached to an inwardly facing side 77 of the station platform 41. Such light sources 65-67 are selectively illuminated between active and inactive modes when the first triggering event and the second trigger event are detected, respectively.

In a non-limiting exemplary embodiment, such illuminable light sources 65-67 include, for example, warning lights. In addition, emergency stop sensors (similar to an elevator door), rubberized bottom cushions and an audio warning system 10 may be employed by the light sources 65-67. For example, audible messages are replayed to remind passengers to stand away from the outwardly facing side 77 of the station platform 41) before barricade platform 11 is vertically raised (closed) and lowered (opened). Thus, the disclosure provides both audio and visual messages along with (or independently of) a physical barricade platform 11 at the station platform 41 so that no one will fall or be pushed onto the path of an oncoming train. The vertical displacement of a barricade platform 11 allows connection to the station platform 41 and stops people from falling or being pushed onto train tracks. The barricade platform 11 also has sensors to automatically stop and/or reverse directions in case someone or something is obstructing its vertical travel path 25. Thus, the controller 13 automatically learns when it is safe to vertically raise and lower the barricade platform 11 as the train approaches and departs. Of course, a manual override switch is provided as well.

In a non-limiting exemplary embodiment, the automatic barricade platform reciprocating mechanism 12 preferably includes a power-actuated drive mechanism 50 centrally engaged to a bottom surface of the barricade platform 11 wherein the drive mechanism 50 is adapted to be supported by the outwardly facing side 77 of the station platform 41, a controller 13 including a processor 30 and a memory 31 communicatively coupled thereto, a plurality of sensors 23, 24 located at the barricade platform 11 and being communicatively coupled to the controller 13 respectively, and a light switch 69 communicatively coupled to the controller 13 and the light sources 65-67. In this manner, the controller 13 causes the drive mechanism 50 to toggle between alternate operating modes upon detecting the first and second triggering events, respectively. Furthermore, the controller 13 causes the light switch 69 to toggle between closed and open positions upon detecting the first and second triggering events, respectively.

In a non-limiting exemplary embodiment, the memory 31 includes programmable software instructions that cause the controller 13 to verify an authenticity of the first and second triggering events.

In a non-limiting exemplary embodiment, a first group 23 of the sensors generates and transmits true first output signals upon detecting the first triggering event respectively. A second group 24 of the sensors generates and transmits true second output signals upon detecting the second triggering event respectively. In this manner, the first and second sensor groups 23, 24 generate and transmit respective first and second false output signals when the first and second triggering events are not detected.

In a non-limiting exemplary embodiment, the controller 13 is responsive to the first and second outputs signals and thereby generates and transmits first and second control signals to the drive mechanism 50 upon receiving the true first and second output signals respectively. Notably, upon receiving the first and second control signals, the drive mechanism 50 is caused to rotate in clockwise and counter clockwise directions (collectively at 78), respectively. Furthermore, upon receiving the true first and second output signals, the controller 13 further generates and transmits third and fourth control signals to the light switch 69 thereby toggling the light switch 69 between the closed position and the open position respectively. In this manner, the light sources 65-67 are activated and deactivated when the light switch 69 is at the closed position and open position, respectively.

In a non-limiting exemplary embodiment, the drive mechanism 50 includes a rotary motor 51 adapted to be coupled to an existing power source 79 at the train station (e.g., barrier platform 11), and a plurality of rectilinear drive shafts 14, 15 directly coupled to the rotary motor 51 respectively wherein each of the drive shafts 14, 15 is coupled to the rotary motor 51 and oppositely extends away therefrom respectively. Notably, the drive shafts 14, 15 are registered along a linear axis oriented parallel to a rear edge of the barricade platform 11, as perhaps best shown in FIG. 2.

In a non-limiting exemplary embodiment, the drive mechanism 50 further includes a driven shaft 60 spaced from the drive shafts 14, 15 and registered parallel thereto, a plurality of primary cogwheels 16, 17 anchored to respective distal ends of the drive shafts 14, 15 wherein each of the primary cogwheels 16, 17 is synchronously rotated with the drive shafts 14, 15 as the motor 51 rotates in the clockwise and counter clockwise directions (collectively at 78). A plurality of secondary cogwheels 61, 62 are anchored to distal ends of the driven shaft 60 wherein each of the secondary cogwheels 61, 62 is synchronously rotated with the driven shaft 60 as the motor 51 rotates in the clockwise and counter clockwise directions (collectively at 78).

In a non-limiting exemplary embodiment, the drive mechanism 50 further includes a plurality of primary serrated tracks 18, 19 statically connected directly to the bottom surface of the barricade platform 11 wherein the primary serrated tracks 18, 19 are configured in such a manner that the primary cogwheels 16, 17 remain continuously and directly engaged with the primary serrated tracks 18, 19 during the reciprocating motions. A plurality of secondary serrated tracks 88, 89 statically connected directly to the bottom surface of the barricade platform 11 wherein the secondary serrated tracks 88, 89 are configured in such a manner that the secondary cogwheels 61, 62 remain continuously and directly engaged with the secondary serrated tracks 88, 89 during the reciprocating motions.

In a non-limiting exemplary embodiment, the barricade platform 11 is caused to linearly reciprocate along the vertical plane (along path 25) as the drive shafts 14, 15, the driven shaft 60, the primary cogwheels 16, 17, and the secondary cogwheels 61, 62 rotate along the clockwise and counter clockwise directions (collectively at 78) respectively.

In a non-limiting exemplary embodiment, the automatic barricade platform 11 reciprocating means further includes a plurality of primary protective guide rails 20, 21 situated at opposed lateral ends of the barricade platform 11 respectively, wherein such primary protective guide rails 20, 21 are anchored to the outwardly facing side 77 of the station platform 41. A plurality of secondary protective guide rails 63, 64 situated at opposed lateral ends of the barricade platform 11 respectively, wherein such secondary protective guide rails 63, 64 being anchored to the outwardly facing side 77 of the station platform 41. A plurality of primary guide wheels 22 rotatably attached within each of the primary protective guide rails 20, 21, wherein the primary guide wheels 22 are configured in such a manner that the barricade platform 11 remains intercalated between anterior and posterior rows of the primary protective guide rails 20, 21 while reciprocating between the retracted and extended positions respectively. A plurality of secondary guide wheels 82 are rotatably attached within each of the secondary protective guide rails 63, 64, wherein the secondary guide wheels 82 are configured in such a manner that the barricade platform 11 remains intercalated between anterior and posterior rows of the secondary protective guide rails 63, 64 while reciprocating between the retracted and fully extended positions respectively.

In a non-limiting exemplary embodiment, each of the primary protective guide rails 20, 21 and the secondary protective guide rails 63, 64 has a longitudinal length registered parallel to the linear travel path 25 of the barricade platform 11 for maintaining the barricade platform 11 at a substantially stable position during repeated reciprocating movement.

For any hurried commuter—and especially for those elderly or mobility-restricted commuters for whom these transitions are a particular obstacle—the retractable safety platform system 10 provides a convenient, reliable barrier between the train and the station platform 41.

The present disclosure further includes a method of utilizing a retractable barricade platform system 10 between a train and a station platform 41 thereby ensuring a passenger will not fall or be pushed onto a path of the train. Such a method includes the steps of: providing and anchoring a rigid barricade platform 11 to an outwardly facing side 77 of the station platform 41 registered along a vertical plane (along path 25); and providing a mechanism 12 for automatically reciprocating the barricade platform 11 along a vertical linear travel path 25 upon detecting first and second triggering events respectively, wherein the linear travel path 25 is defined along the vertical plane extending above and below a top surface 41*a* of the station platform 41. Such first and second triggering events may be defined as opening and closing operations of the train doors. However, the triggering events may also be defined when the train comes to a complete stop and begins moving thereafter, respectively.

The method further includes the steps of: when the first triggering event is detected, displacing the barricade platform 11 from a lowered retracted position to a raised extended position; and when the second triggering event is detected, displacing the barricade platform 11 from the raised extended position to the lowered retracted position.

The lowered fully retracted position may be defined when the barricade platform 11 is disposed beneath the top surface 41*a* of station platform 41. The raised fully extended position may be defined when the barricade platform 11 is disposed above the top surface 41*a* of station platform 41. Likewise, the barricade platform 11 may be automatically displaced from the fully extended position to the retracted position when the second triggering event is detected.

Advantageously, the centrally mounted drive mechanism 50 provides not only the power-actuated input for the barricade platform 11 motions, but also provides balance to the barricade platform 11. Through the connecting drive shafts 14, 15 and cogwheels 16-17 and 61-62, the drive mechanism 50 serves to further anchor the remaining components of the automatic barricade platform reciprocating mechanism 12 to the outwardly facing side 77 of the station platform 41.

The automatic barricade platform reciprocating mechanism 12 further includes a controller 13 provided with a processor 30 and a memory 31 electrically coupled thereto. The processor 30 may include a microprocessor or other systems capable of being programmed or configured to perform computations and instruction processing in accordance with the disclosure. Such other systems may include microcontrollers, digital signal processors (DSP), Complex Programmable Logic System (CPLD), Field Programmable Gate Arrays (FPGA), application-specific integrated circuits (ASIC), discrete gate logic, and/or other integrated circuits, hardware or firmware in lieu of or in addition to a microprocessor.

Functions and process steps described herein may be performed using programmed computer systems and related hardware, peripherals, equipment and networks. When programmed, the computing system is configured to perform functions and carry out steps in accordance with principles of the disclosure. Such programming may comprise operating systems, software applications, software modules, scripts, files, data, digital signal processors (DSP), application-specific integrated circuit (ASIC), discrete gate logic, or other hardware, firmware, or any conventional programmable software, collectively referred to herein as a module.

The memory 31 preferably includes programmable software instructions that are executed by the processor 30. In particular, the programmable software instructions include a plurality of chronological operating steps that define a control logic algorithm for performing the intended functions of the present disclosure. Such software instructions may be written in a variety of computer program languages such as C++, Fortran and Pascal, for example. One skilled in the art understands that such software instructions may contain various Boolean logic processes that perform the intended function of the present disclosure. Therefore, the specific source or object code of the software program is not intended to be a limiting factor in executing the present disclosure's intended function.

The memory 31, which enables storage of data and programs, may include RAM, ROM, flash memory and any other form of readable and writable storage medium known in the art or hereafter developed. The memory 31 may be a separate component or an integral part of another component such as processor 30. Such a memory 31 preferably includes programmable software instructions that cause the controller 13 to verify an authenticity of the first and second triggering events. Upon detecting the first and second triggering events, a first group 23 of the sensors may generate and transmit true first output signals. Similarly, a second group 24 of the sensors may generate and transmit true second output signals upon detecting the second triggering event respectively. Such first and second sensor groups 23, 24 preferably generate and transmit respective first and second false output signals when the first and second triggering events are not detected.

The two groups of sensors 23, 24 may include any suitably sensors. For example, motion and/or light sensors may be provided to cause the present disclosure to detect the first and second triggering events, for example. Active and/or passive sensors may be used to react to detectable subject matter such as light, noise, radiation (e.g., heat), or changes in emitted energy, fields or beams. However, the disclosure is not limited to a particular type of sensor.

Those skilled in the art will appreciate that other sensors may be used without departing from the scope of the disclosure. Examples of such other sensors include pressure sensitive mats; optical sensors configured to sense light; microwave sensors that use a Gunn diode operating within pre-set limits to transmit/flood a designated area/zone with an electronic field whereby movement in the zone disturbs the field and sets off an alarm; an ultrasonic sensor configured to react to a determined range of ultrasonic sound energy in a protected area; or any other sensor capable of providing motion detection capability in accordance with principles of the disclosure.

Figure 2:
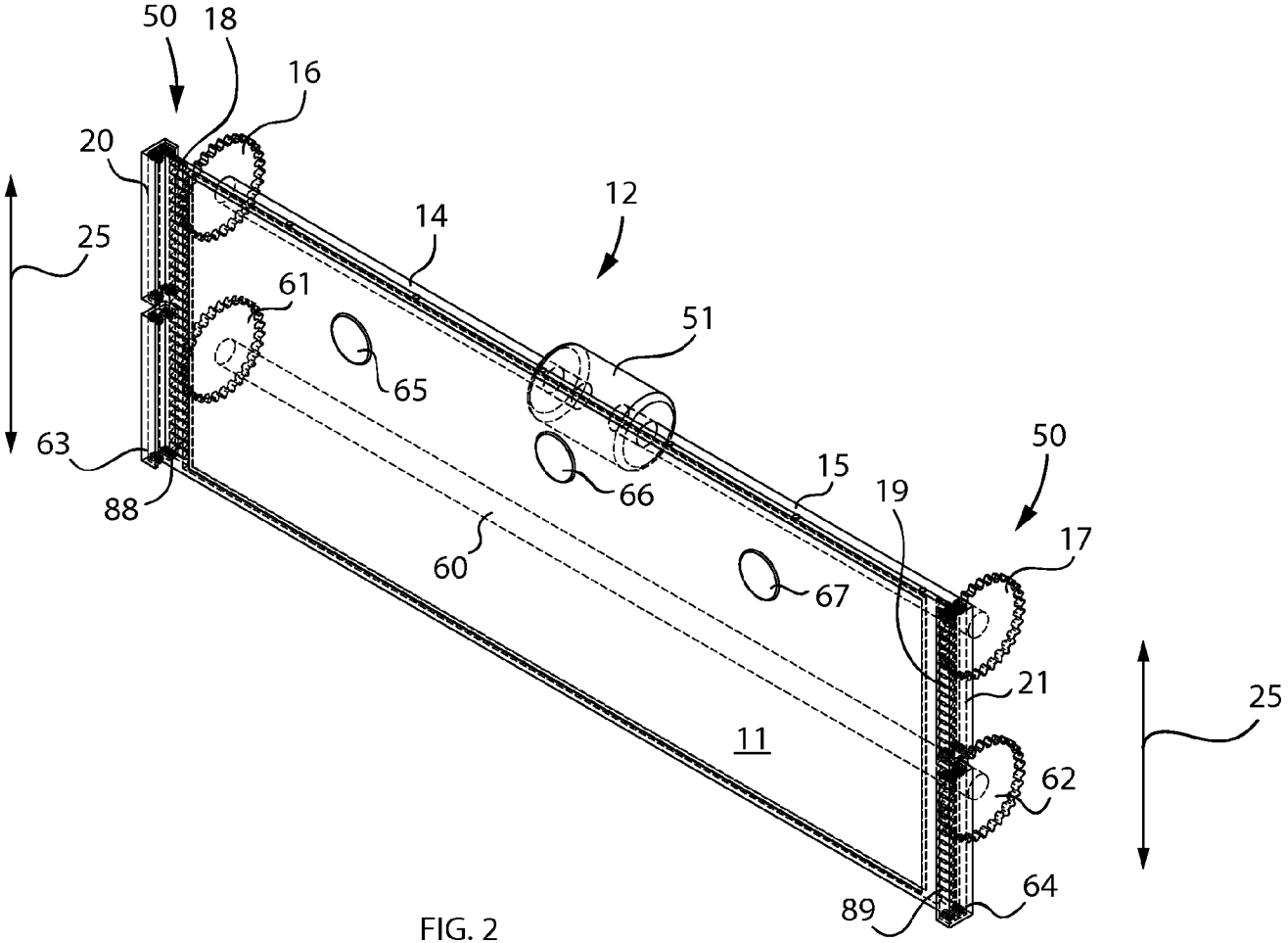
FIG. 2 is a perspective view showing a barricade platform operably supported by an automated barricade platform reciprocating mechanism and drive mechanism.
Figure 3:
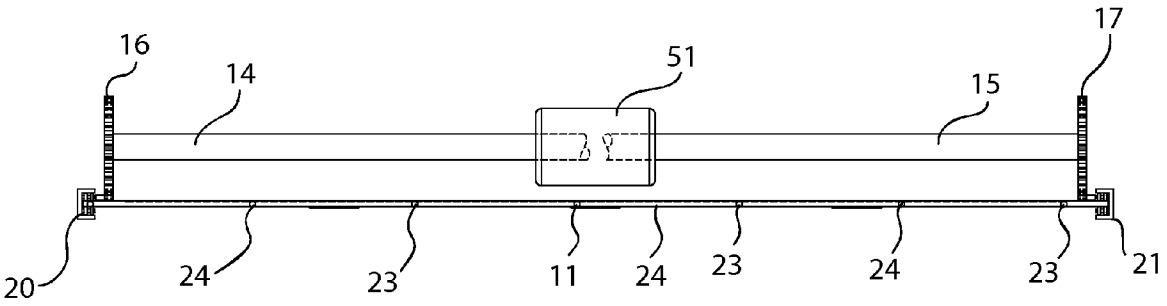
FIGS. 3 and 4 are top and front elevational views of the barricade platform cooperating with the automated barricade platform reciprocating mechanism and drive mechanism shown in FIG. 2.
Figure 4:
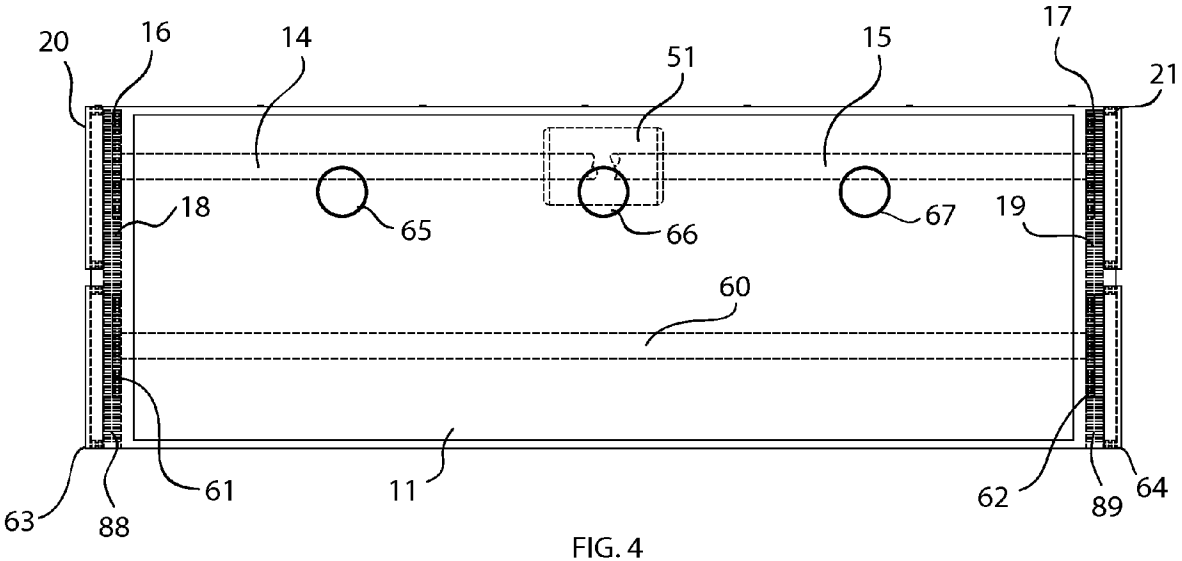
Figure 5:
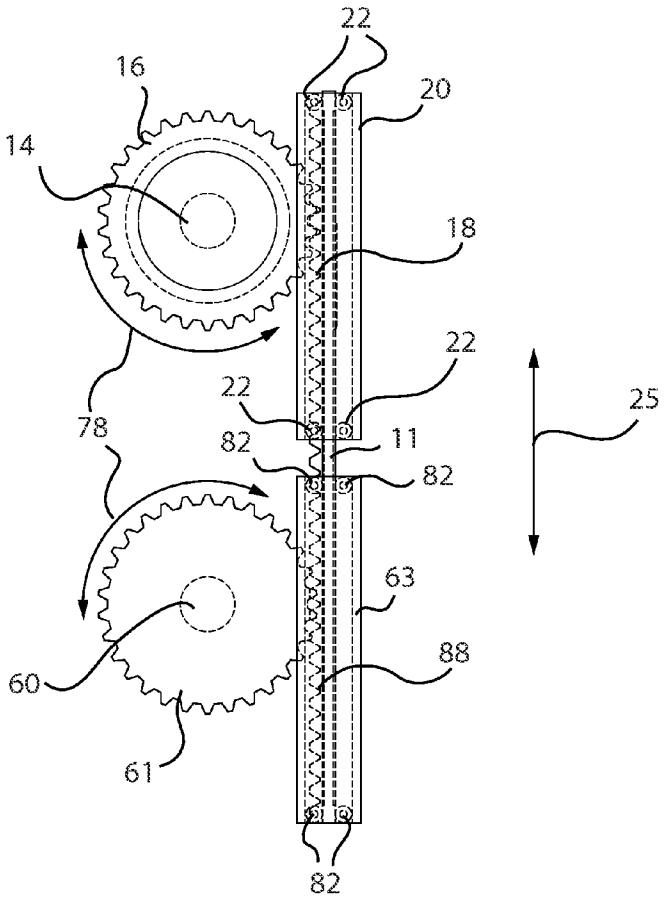
FIG. 5 is an enlarged side elevational view showing one of primary and secondary cogwheels in communication with an associated one of primary and secondary serrated tracks.
Figure 6:
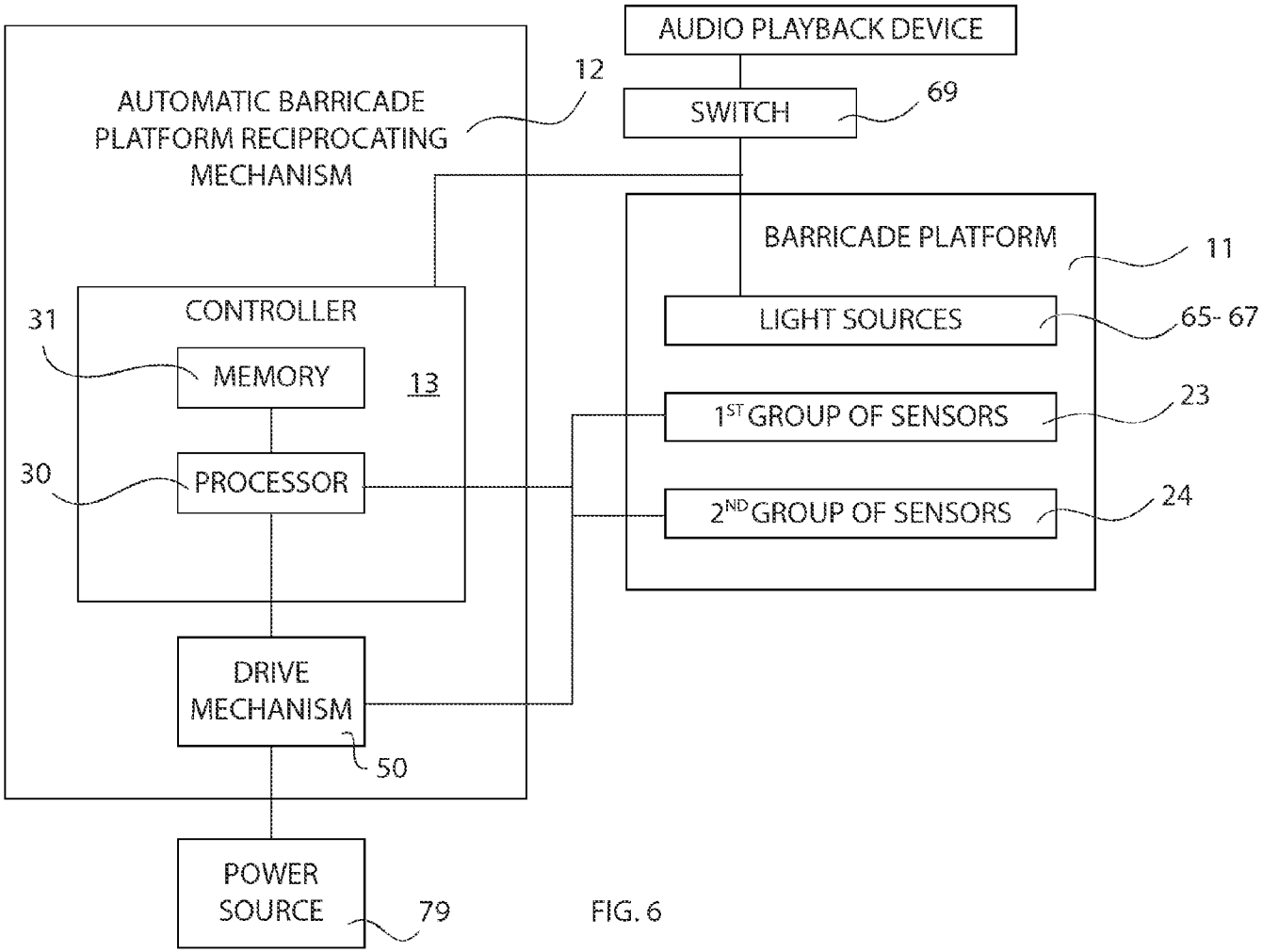
FIG. 6 is a high level schematic block diagram showing the interrelationship between the major electronic components of the present disclosure.

Notably, the drive shafts 14, 15 may be registered along a linear axis oriented parallel to a rear edge of the barricade platform 11, as perhaps best shown in FIGS. 2 and 4.

In one embodiment, each of the protective guide rails 20-21 and 63-64 has a longitudinal length registered parallel to the linear travel path 25 of the barricade platform 11 for maintaining the barricade platform 11 at a substantially stable position during repeated reciprocating movement.

For any hurried commuter—and especially for those elderly or mobility-restricted commuters for whom these transitions are a particular obstacle—the retractable barricade platform system 10 provides a physical barricade platform 11 along with audio and visual warning messages at a station platform 41 so that a passenger will not fall or be pushed onto a path of an oncoming train.

While the disclosure has been described with respect to a certain specific embodiment, it will be appreciated that many modifications and changes may be made by those skilled in the art without departing from the spirit of the disclosure. It is intended, therefore, by the appended claims to cover all such modifications and changes as fall within the true spirit and scope of the disclosure.

In particular, with respect to the above description, it is to be realized that the optimum dimensional relationships for the parts of the present disclosure may include variations in size, materials, shape, form, function and manner of operation. The system and use of the present disclosure are deemed readily apparent and obvious to one skilled in the art.

What is claimed as new and what is desired to secure by Letters Patent of the United States is:

1. A retractable safety platform system for use between a train and a station platform thereby ensuring a passenger will not fall or be pushed onto a path of the train, said retractable safety platform system comprising:

a station platform;

a barricade platform being anchored to an outwardly facing side of the station platform registered along a vertical plane; and means for automatically reciprocating said barricade platform along a vertical linear travel path upon detecting first and second triggering events respectively;

wherein said barricade platform is displaced from a lowered retracted position to a raised extended position when said first triggering event is detected;

wherein said barricade platform is displaced from the raised extended position to the lowered retracted position when said second triggering event is detected;

wherein said linear travel path is defined along the vertical plane extending above and below a top surface of the station platform;

wherein said automatic barricade platform reciprocating means is disposed at an outwardly facing side of said barricade platform such that said barricade platform is intercalated between said automatic barricade platform reciprocating means and said outwardly facing side of said station platform.

2. The retractable safety platform system of claim 1, further comprising: a plurality of light sources attached to an inwardly facing side of said barricade platform, said light sources being selectively illuminated between active and inactive modes when said first triggering event and said second trigger event are detected, respectively.

3. The retractable safety platform system of claim 2, wherein said automatic barricade platform reciprocating means comprises:

a power-actuated drive mechanism centrally engaged to a bottom surface of said barricade platform, said drive mechanism adapted to be connected to the outwardly facing side of the station platform;

a controller including a processor and a memory communicatively coupled thereto;

a plurality of sensors located at said barricade platform and being communicatively coupled to said controller respectively; and a light switch communicatively coupled to said controller and said light sources;

wherein said controller causes said drive mechanism to toggle between alternate operating modes upon detecting said first and second triggering events respectively;

wherein said controller causes said light switch to toggle between closed and open positions upon detecting said first and second triggering events respectively.

4. The retractable safety platform system of claim 3, wherein said memory comprises: programmable software instructions that cause said controller to verify an authenticity of said first and second triggering events.

5. The retractable safety platform system of claim 4, wherein a first group of said sensors generates and transmits true first output signals upon detecting said first triggering event respectively, a second group of said sensors generating and transmitting true second output signals upon detecting said second triggering event respectively;

wherein said first and second sensor groups generate and transmit respective first and second false output signals when said first and second triggering events are not detected.

6. The retractable safety platform system of claim 5, wherein said controller is responsive to said first and second outputs signals and thereby generates and transmits first and second control signals to said drive mechanism upon receiving said true first and second output signals respectively;

wherein, upon receiving said first and second control signals, said drive mechanism is caused to rotate in clockwise and counter clockwise directions respectively;

wherein, upon receiving said true first and second output signals, said controller further generates and transmits third and fourth control signals to said light switch thereby toggling said light switch between the closed position and the open position respectively;

wherein said light sources are activated and deactivated when said light switch is at the closed position and open position, respectively.

7. The retractable safety platform system of claim 6, wherein said drive mechanism comprises:

a rotary motor adapted to be coupled to an existing power source located at the barricade platform;

a plurality of rectilinear drive shafts directly coupled to said rotary motor respectively, each of said drive shafts being coupled to said rotary motor and oppositely extending away therefrom respectively, said drive shafts being registered along a linear axis oriented parallel to a rear edge of said barricade platform;

a driven shaft spaced from said drive shafts and registered parallel thereto;

a plurality of primary cogwheels anchored to respective distal ends of said drive shafts, each of said primary cogwheels being synchronously rotated with said drive shafts as said motor rotates in the clockwise and counter clockwise directions;

a plurality of secondary cogwheels anchored to distal ends of said driven shaft, each of said secondary cogwheels being synchronously rotated with said driven shaft as said motor rotates in the clockwise and counter clockwise directions;

a plurality of primary serrated tracks statically connected directly to said bottom surface of said barricade platform, said primary serrated tracks being configured in such a manner that said primary cogwheels remain continuously and directly engaged with said primary serrated tracks during the reciprocating motions; and a plurality of secondary serrated tracks statically connected directly to said bottom surface of said barricade platform, said secondary serrated tracks being configured in such a manner that said secondary cogwheels remain continuously and directly engaged with said secondary serrated tracks during the reciprocating motions.

8. The retractable safety platform system of claim 7, wherein said barricade platform is caused to linearly reciprocate along said vertical plane as said drive shafts, said driven shaft, said primary cogwheels, and said secondary cogwheels rotate along the clockwise and counter clockwise directions respectively.

9. The retractable safety platform system of claim 8, wherein said automatic barricade platform reciprocating means further comprises:

a plurality of primary protective guide rails situated at opposed lateral ends of said barricade platform respectively, said primary protective guide rails being anchored to said outwardly facing side of the station platform;

a plurality of secondary protective guide rails situated at opposed lateral ends of said barricade platform respectively, said secondary protective guide rails being anchored to said outwardly facing side of the station platform;

a plurality of primary guide wheels rotatably attached within each of said primary protective guide rails, said primary guide wheels being configured in such a manner that said barricade platform remains intercalated between anterior and posterior rows of said primary protective guide rails while reciprocating between the retracted and extended positions respectively; and a plurality of secondary guide wheels rotatably attached within each of said secondary protective guide rails, said secondary guide wheels being configured in such a manner that said barricade platform remains intercalated between anterior and posterior rows of said secondary protective guide rails while reciprocating between the retracted and fully extended positions respectively.

10. A retractable safety platform system for use between a train and a station platform thereby ensuring a passenger will not fall or be pushed onto a path of the train, said retractable safety platform system comprising:

a station platform;

a rigid barricade platform being anchored to an outwardly facing side of said station platform registered along a vertical plane; and means for automatically reciprocating said barricade platform along a vertical linear travel path upon detecting first and second triggering events respectively;

wherein said barricade platform is displaced from a lowered retracted position to a raised extended position when said first triggering event is detected;

wherein said barricade platform is displaced from the raised extended position to the lowered retracted position when said second triggering event is detected;

wherein said linear travel path is defined along the vertical plane extending above and below a top surface of the station platform;

wherein said automatic barricade platform reciprocating means is disposed outwardly and away from said outwardly facing side of said station platform as well as from beneath said station platform.

11. The retractable safety platform system of claim 10, further comprising: a plurality of light sources attached to an inwardly facing side of said barricade platform, said light sources being selectively illuminated between active and inactive modes when said first triggering event and said second trigger event are detected, respectively.

12. The retractable safety platform system of claim 11, wherein said automatic barricade platform reciprocating means comprises:

a power-actuated drive mechanism centrally engaged to a bottom surface of said barricade platform, said drive mechanism adapted to be connected to the outwardly facing side of the station platform;

a controller including a processor and a memory communicatively coupled thereto;

a plurality of sensors located at said barricade platform and being communicatively coupled to said controller respectively; and a light switch communicatively coupled to said controller and said light sources;

wherein said controller causes said drive mechanism to toggle between alternate operating modes upon detecting said first and second triggering events respectively;

wherein said controller causes said light switch to toggle between closed and open positions upon detecting said first and second triggering events respectively.

13. The retractable safety platform system of claim 12, wherein said memory comprises: programmable software instructions that cause said controller to verify an authenticity of said first and second triggering events.

14. The retractable safety platform system of claim 13, wherein a first group of said sensors generates and transmits true first output signals upon detecting said first triggering event respectively, a second group of said sensors generating and transmitting true second output signals upon detecting said second triggering event respectively;

wherein said first and second sensor groups generate and transmit respective first and second false output signals when said first and second triggering events are not detected.

15. The retractable safety platform system of claim 14, wherein said controller is responsive to said first and second outputs signals and thereby generates and transmits first and second control signals to said drive mechanism upon receiving said true first and second output signals respectively;

wherein, upon receiving said first and second control signals, said drive mechanism is caused to rotate in clockwise and counter clockwise directions respectively;

wherein, upon receiving said true first and second output signals, said controller further generates and transmits third and fourth control signals to said light switch thereby toggling said light switch between the closed position and the open position respectively;

wherein said light sources are activated and deactivated when said light switch is at the closed position and open position, respectively.

16. The retractable safety platform system of claim 15, wherein said drive mechanism comprises:

a rotary motor adapted to be coupled to an existing power source located at the barricade platform;

a plurality of rectilinear drive shafts directly coupled to said rotary motor respectively, each of said drive shafts being coupled to said rotary motor and oppositely extending away therefrom respectively, said drive shafts being registered along a linear axis oriented parallel to a rear edge of said barricade platform;

a driven shaft spaced from said drive shafts and registered parallel thereto;

a plurality of primary cogwheels anchored to respective distal ends of said drive shafts, each of said primary cogwheels being synchronously rotated with said drive shafts as said motor rotates in the clockwise and counter clockwise directions;

a plurality of secondary cogwheels anchored to distal ends of said driven shaft, each of said secondary cogwheels being synchronously rotated with said driven shaft as said motor rotates in the clockwise and counter clockwise directions;

a plurality of primary serrated tracks statically connected directly to said bottom surface of said barricade platform, said primary serrated tracks being configured in such a manner that said primary cogwheels remain continuously and directly engaged with said primary serrated tracks during the reciprocating motions; and a plurality of secondary serrated tracks statically connected directly to said bottom surface of said barricade platform, said secondary serrated tracks being configured in such a manner that said secondary cogwheels remain continuously and directly engaged with said secondary serrated tracks during the reciprocating motions.

17. The retractable safety platform system of claim 16, wherein said barricade platform is caused to linearly reciprocate along said vertical plane as said drive shafts, said driven shaft, said primary cogwheels, and said secondary cogwheels rotate along the clockwise and counter clockwise directions respectively.

18. The retractable safety platform system of claim 17, wherein said automatic barricade platform reciprocating means further comprises:

a plurality of primary protective guide rails situated at opposed lateral ends of said barricade platform respectively, said primary protective guide rails being anchored to said outwardly facing side of the station platform;

a plurality of secondary protective guide rails situated at opposed lateral ends of said barricade platform respectively, said secondary protective guide rails being anchored to said outwardly facing side of the station platform;

a plurality of primary guide wheels rotatably attached within each of said primary protective guide rails, said primary guide wheels being configured in such a manner that said barricade platform remains intercalated between anterior and posterior rows of said primary protective guide rails while reciprocating between the retracted and extended positions respectively; and a plurality of secondary guide wheels rotatably attached within each of said secondary protective guide rails, said secondary guide wheels being configured in such a manner that said barricade platform remains intercalated between anterior and posterior rows of said secondary protective guide rails while reciprocating between the retracted and fully extended positions respectively.

19. The retractable safety platform system of claim 18, wherein each of said primary protective guide rails and said secondary protective guide rails has a longitudinal length registered parallel to said linear travel path of said barricade platform for maintaining said barricade platform at a substantially stable position during repeated reciprocating movement.

20. A method of utilizing a retractable safety platform system between a train and a station platform thereby ensuring a passenger will not fall or be pushed onto a path of the train, said method comprising the steps of:

providing a station platform;

providing and anchoring a rigid barricade platform to an outwardly facing side of the station platform registered along a vertical plane;

providing a mechanism for automatically reciprocating said barricade platform along a vertical linear travel path upon detecting first and second triggering events respectively, wherein said linear travel path is defined along the vertical plane extending above and below a top surface of the station platform;

when said first triggering event is detected, displacing said barricade platform from a lowered retracted position to a raised extended position; and when said second triggering event is detected, displacing said barricade platform from the raised extended position to the lowered retracted position;

wherein said automatic barricade platform reciprocating means is disposed at an outwardly facing side of said barricade platform such that said barricade platform is intercalated between said automatic barricade platform reciprocating means and said outwardly facing side of said station platform;

wherein said automatic barricade platform reciprocating means is disposed outwardly and away from said outwardly facing side of said station platform as well as from beneath said station platform.

* * * * *